US006386737B1

(12) United States Patent
Hopp et al.

(10) Patent No.: US 6,386,737 B1
(45) Date of Patent: May 14, 2002

(54) GOBO ROTATION SYSTEM

(76) Inventors: Armin Hopp, Nordstrasse 50, Bonn (DE), D-53111; Dirk Bertelmann, Moltkestrasse 96, Köln (DE), D-50859

( * ) Notice: Subject to any disclaimer, the term of this patent is extended or adjusted under 35 U.S.C. 154(b) by 0 days.

(21) Appl. No.: 09/743,444

(22) PCT Filed: Jul. 10, 1999

(86) PCT No.: PCT/DE99/02120

§ 371 Date: Jul. 12, 2001

§ 102(e) Date: Jul. 12, 2001

(87) PCT Pub. No.: WO00/03176

PCT Pub. Date: Jan. 20, 2000

(30) Foreign Application Priority Data

Jul. 10, 1998 (DE) ..... 198 31 027

(51) Int. Cl.[7] ..... F21V 21/14

(52) U.S. Cl. ..... 362/282; 362/293; 362/322; 359/813

(58) Field of Search ..... 362/282, 284, 362/271, 275, 277, 319, 322, 293; 359/889, 892

(56) References Cited

U.S. PATENT DOCUMENTS 5,402,326 A * 3/1995 Belliveau ..... 359/813
5,537,303 A * 7/1996 Stacy ..... 362/282

* cited by examiner

*Primary Examiner*—Alan Cariaso
*Assistant Examiner*—Hargobind S. Sawhney
(74) *Attorney, Agent, or Firm*—Vorys, Sater, Seymour & Pease LLP

(57) ABSTRACT

Effect wheel rotation system, having a base and at least one effect wheel which is coupled thereto and can be rotated about an axis of rotation by means of a drive, the axis of rotation being arranged offset with respect to an optical axis and the effect wheel having at least one optical element which can be rotated into the region of the optical axis, in which system the effect wheel, independently of a rotation about the axis of rotation, can also be rotated about the optical axis.

12 Claims, 2 Drawing Sheets

GOBO ROTATION SYSTEM

Figure 1:
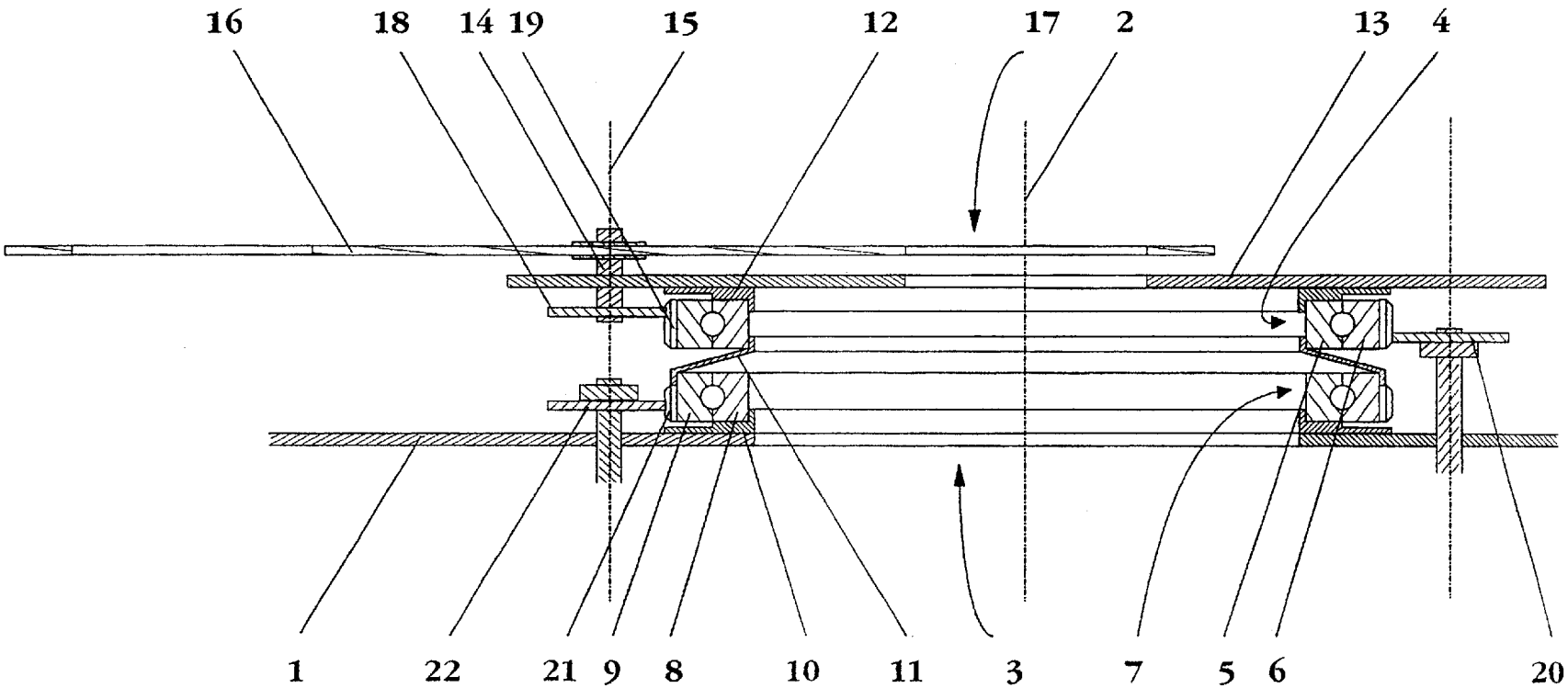

The invention relates to an effect wheel rotation system, having a base and at least one effect wheel which is coupled thereto and can be rotated about an axis of rotation by means of a drive, the axis of rotation being arranged offset with respect to an optical axis and the effect wheel having at least one optical element which can be rotated into the region of the optical axis.

Effect wheel rotation systems of this type, which are also known as gobo rotation systems, are used primarily in stage lighting engineering. The effect wheels usually have in their outer region a multiplicity of apertures which lie next to one another in the circumferential direction and in which various optical elements are arranged, such as for example colour filters or diaphragm wheels. The effect wheel is mounted so that it can rotate about an axis, the distance of this axis from the optical axis of the effect wheel rotation system being equal to the distance between the axis of rotation of the effect wheel and the centre point of its apertures. It is thus possible for every optical element of the effect wheel to be rotated into the optical axis, so that a light beam can be influenced in various ways by the effect wheel rotation system. The base serves as a support for the effect wheel rotation system and may, for example, be a mounting plate for attaching the effect wheel rotation system to a spotlight or scaffold. However, it may also be a direct component of a spotlight or scaffold.

A large number of effect wheel rotation systems are known. For example, U.S. Pat. No. 5,113,332 describes an effect wheel rotation system with a plurality of effect wheels which lie one behind the other in the direction of the optical axis, are mounted so that they can rotate about a common centre axis and in their outer region have apertures holding different optical elements in order to produce different patterns. Each of these effect wheels has one aperture without an optical element. When an optical element of an effect wheel is rotated into the region of the, optical axis of a light beam, the clear apertures of the other effect wheels can be pivoted into the region of the optical axis, so that only one optical element is influencing the light beam. Furthermore, the optical elements are mounted rotatably in the effect wheel. As soon as they are rotated into the region of the optical axis, they can be rotated by means of a drive. This system has the drawback that the optical elements can only be rotated by the drive when they have reached the region of the optical axis. It is therefore not possible for the optical element to enter the region of the optical axis in a predetermined position. However, this is of particular interest if not only the colour but also the contour of the light beam is to be influenced using the optical elements or if an image is to be projected via the optical element.

U.S. Pat. No. 5,537,303 has disclosed an effect wheel rotation system in which this problem does not exist. It has an effect wheel, in the outer region of which optical elements are rotatably mounted. The optical elements are provided with toothed rings which each engage in a gearwheel which is mounted so that it can rotate about the centre axis of the effect wheel. The effect wheel and the gearwheel can be rotated independently of one another about the same axis. The two components are rotated by means of separately controlled drives. However, this structure has the drawback that each optical element has to be rotatably mounted and has to be provided with a toothed ring. Therefore, this structure is complex and expensive.

By contrast, the present invention is based on the object of avoiding the abovementioned drawbacks and of providing a simple and inexpensive effect wheel rotation system in which at least one optical element can be rotated about its own axis and can be pivoted into the optical axis of the effect wheel rotation system.

In an effect wheel of the type described in the introduction, this object is achieved by the fact that the effect wheel, independently of a rotation about the axis of rotation, can be rotated about the optical axis.

Rotation about its own axis of rotation in this case leads to an optical element which is to influence the light beam being rotated into the optical region. Since the effect wheel can be rotated about the optical axis, the optical element which has been pivoted into the region of the optical axis can be rotated about the optical axis and therefore—provided that the optical axes of the optical element and the effect wheel rotation system lie on top of one another—about its own optical axis.

One advantage of this system according to the invention over the prior art consists in the fact that only the effect wheel has to be drivable about two different axes. Therefore, the number of moving parts in the system always remains constant, irrespective of how many optical elements are on the effect wheel. In addition to the ensuing advantage of simple production at reduced costs, the reduced number of moving parts leads to a further advantage with regard to the susceptibility of the system to faults. In addition, the type and size of optical elements which can be used in the effect wheel are not restricted by mechanical elements, such as for example a toothed ring, which has hitherto been required for rotation of the optical elements about their own axis. This inevitably results in the further advantage that the number of optical elements can be selected as desired. Finally, it is possible to allow an optical element to rotate, away from the centre by a specific radius, about the optical axis of the effect wheel rotation system if, in this case, the distance of the axis of rotation of the effect wheel from the optical axis is unequal, by this very radius, to the distance between the axis of rotation of the effect wheel and the centre point of the aperture for the optical element and the optical axis of the optical element.

In a simple configuration of the invention, the axis of rotation of the effect wheel is its centre axis, so that in the case of a circular effect wheel all the optical elements which are arranged next to one another, at identical distances from the centre axis, in the circumferential direction can be pivoted into the same region of the optical axis of the effect wheel rotation system.

In a particular embodiment, the effect wheel rotation system has a rolling bearing arrangement with at least two bearing shells which can rotate relative to one another about the optical axis, a shaft which bears the effect wheel being connected to one bearing shell by means of a connecting element and it being possible for the shaft to roll along the other bearing shell.

If the bearing shell which is connected to the shaft is driven, the effect wheel is as a result rotated about the optical axis of the effect wheel rotation system. At the same time, the effect wheel is rotated about its centre axis as a result of the shaft connected thereto rolling along the other bearing shell of the rolling bearing. This rotary movement can be counteracted if both bearing shells are fixedly connected to one another or are driven at the same angular velocity, so that there is no relative movement between the bearing shells. If the other bearing shell is driven in the opposite direction, the angular velocity produced by the rolling movement is increased further. Therefore, in this embodiment the relative movement between the bearing shells of the rolling bearing arrangement is utilized.

Numerous design embodiments are conceivable in which the two bearing shells of the rolling bearing arrangement may be part of one rolling bearing or may each be part of a different rolling bearing. In one possible embodiment, there is a fixed ring which is arranged around the optical axis of the system and on the inner side of which an inner rolling bearing and on the outer side of which an outer rolling bearing are arranged, in which case the outer bearing shell of the outer rolling bearing and the inner bearing shell of the inner rolling bearing are then able to move freely. The same design principle is achieved if the outer bearing shell of the inner rolling bearing is formed integrally with the inner bearing shell of the outer rolling bearing and the ring which is arranged around the axis of the optical system and is fixedly connected to the base.

In another possible embodiment, it is conceivable for there to be two rolling bearings, in which case each rolling bearing is fixedly attached to its own base.

In a preferred simple structure, the rolling bearing arrangement is formed by a first rolling bearing with at least a first bearing shell and a second bearing shell and also a second rolling bearing with at least a third bearing shell and a fourth bearing shell, both rolling bearings being arranged around the optical axis, the shaft being connected to the first bearing shell by means of the connecting element and it being possible for the shaft to roll along the second bearing shell, the first bearing shell being fixedly connected to the fourth bearing shell and the third bearing shell being attached to the base.

In a particularly preferred embodiment, the two bearing shells which can rotate relative to one another and about the optical axis can be rotated by means of in each case one drive, so that the two bearing shells can be rotated completely independently of one another.

However, in principle it is also possible to provide only one drive. This drive may, for example, drive the bearing shell which is connected to the connecting element, so that the effect wheel can rotate about the axis of the optical system. If only one optical element which has been pivoted into the region of the optical axis is to be rotated about the optical axis, the bearing shell along which the shaft rolls must be connected to the driven bearing shell by means of a driver, so that movement of the two bearing shells relative to one another is suppressed. However, if the optical element is to be changed, the bearing shell along which the shaft rolls has to be held in place, so that the effect wheel, on account of the relative movement between the two bearing shells, rotates about its own axis of rotation.

The drives of the bearing shells preferably have the same transmission ratio. This ensures that, if the drives are moving at the same rotational speed, the bearing shells will rotate at the same angular velocity, so that in this case precisely one optical element in the region of the optical axis is rotated about this axis.

Furthermore, it is advantageous if the bearing shells, and also the shaft, are driven via a geared transmission. The positively locking transmission of forces provided by gearwheels is able at any time to preset an accurately defined position of the effect wheel if, for example, stepper motors are used for driving purposes. Nevertheless, it is also possible to implement the drive in other ways, for example by means of frictional wheels or even to design it as a belt drive.

In another embodiment, the effect wheel can be positioned around the optical axis as a result of the connecting element being designed in the form of an annular disc and being provided with a toothed ring in which a drive engages As a result, the bearing shell which bears the connecting element serves only to bear the connecting element and is no longer used to transmit the driving forces or moments.

Another particular advantage of the effect wheel rotation system according to the invention is that the position of the effect wheel does not have to be accurately fixed with respect to the optical axis, since it can readily be rotated about the optical axis. In this regard, the connecting element may have a lever arm, the lever arm having an articulated joint between the bearing shell which bears the lever arm and the shaft or being articulatedly mounted on this bearing shell and being pivotable about the articulated joint by means of a drive. As a result, the lever can, for example, be pivoted in the plane which is defined by the optical axis and a lever arm which runs radially with respect to the optical axis, with the result that the position of the effect wheel and therefore the position of the optical elements with respect to the optical axis is changed. As a result, given suitable optical elements, such as for example prisms, it is possible to achieve additional optical effects.

It is also possible for a lever arm of this type to be of telescopic design so that its length can be changed by means of a drive. By way of example, this drive can be used to determine whether an optical element rotates eccentrically or centrically about the optical axis of the effect wheel rotation system.

In a specific preferred embodiment, the first and second bearing shells of the first rolling bearing are an inner ring and an outer ring, the inner ring of the first rolling bearing being rotatably connected to the base, the connecting element being arranged on the inner ring and it being possible for the shaft to roll over the outer ring of the first rolling bearing. If the inner ring of the rolling bearing is driven, the effect wheel is as a result rotated about the optical axis of the effect wheel rotation system. At the same time, the effect wheel is rotated about its centre axis as a result of the shaft which is connected to it rolling along the outer ring of the rolling bearing. This rotary movement can be counteracted by the outer ring being moved, by means of its associated drive, in the same direction as the inner ring. If the outer ring is driven in the opposite direction, the angular velocity effected by the rolling movement is increased further. If the inner ring of the rolling bearing is not being moved but the outer ring is being driven, the effect wheel rotates, so that in this way a desired optical element can be moved into the region of the optical axis.

The shaft which bears the effect wheel preferably rolls along the outer ring to an extent which is such that the maximum possible light transmission area of the effect wheel rotation system is not unnecessarily restricted as a result and the rolling bearing(s) used can have a diameter which in relative terms is smaller than if the shaft were to roll along the inner ring of the rolling bearing.

Figure 2:
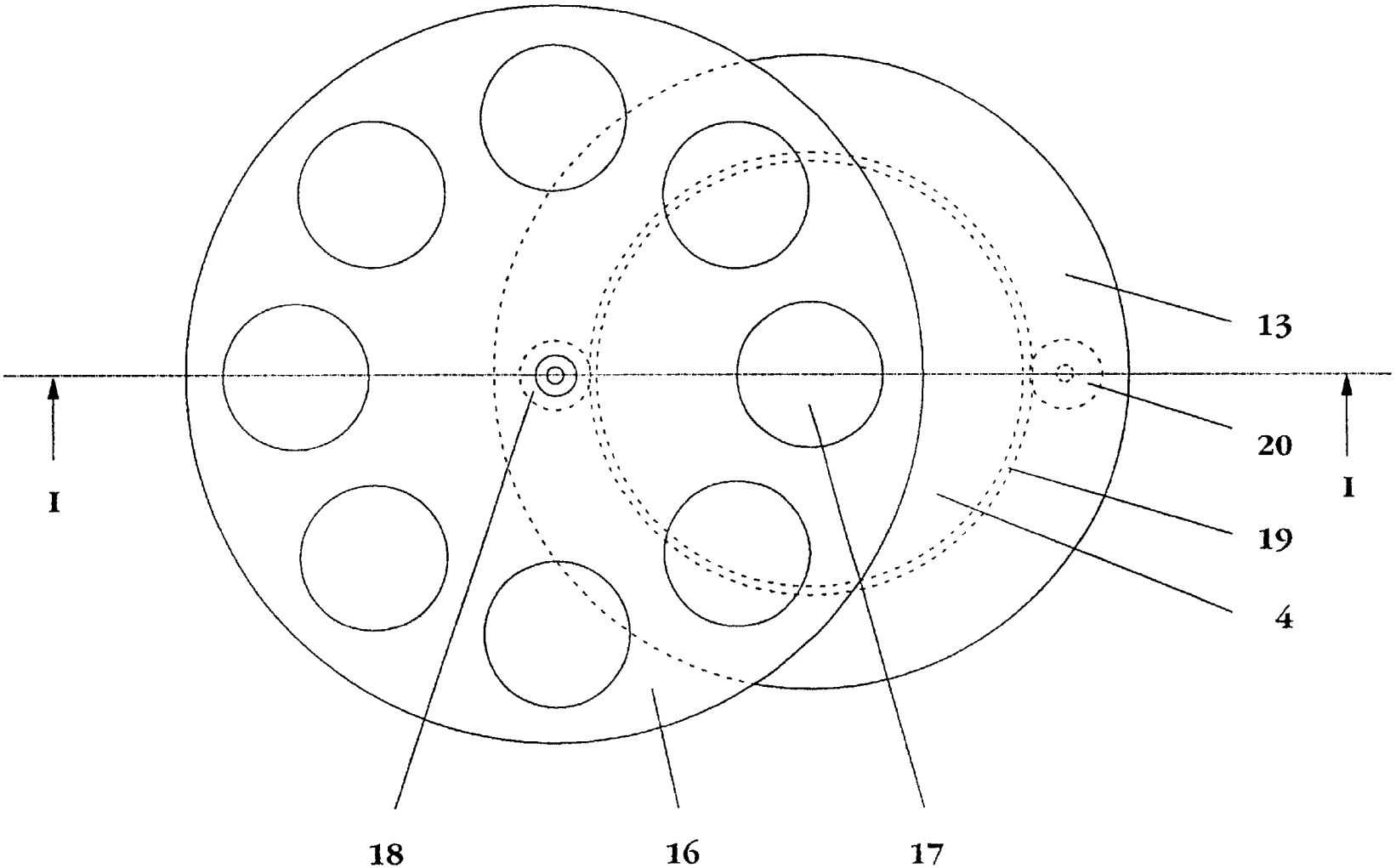

The invention is explained in more detail below with reference to the description of a preferred exemplary embodiment. In the drawing:

FIG. 1 shows a cross section through a preferred embodiment of the invention, and FIG. 2 shows a frontal view of this embodiment.

FIG. 1 shows an effect wheel rotation system with a base 1 which, in the region of an optical axis 2, has an aperture 3 for a light beam. A first rolling bearing 4, which has an inner ring 5 and an outer ring 6, is connected to the base 1 by means of a second rolling bearing 7, which has an inner ring 8 and an outer ring 9. The inner ring 8 of the second rolling bearing 7 is held on the base 1 by means of a press fit provided by a connecting ring 10. The outer ring 9 of the second rolling bearing 7 is connected to the inner ring 5 of the first rolling bearing 4 by means of an annular disc 11 which tapers conically in the axial direction. In this case too, the connection is made in each case by means of press fits. On that side of the first rolling bearing 4 which is remote from the base 1, a second connecting ring 12 engages in the inner ring 5 of the rolling bearing 4 by means of a press fit. This connecting ring is fixedly connected to a connecting element 13 which is designed in the form of an annular disc. The connecting element 13 has an aperture which is concentric with respect to the optical axis, in order to allow a light beam to pass through, and in the radial direction projects fully beyond the first rolling bearing 4.

A shaft 14, the axis 15 of which is arranged parallel to the optical axis 2 of the effect wheel rotation system, is mounted in that region of the connecting element 13 which projects radially beyond the first rolling bearing 4. On that side of the connecting element 13 which is remote from the base 1, the shaft 14 bears an effect wheel 16. As can be seen from FIG. 2, this effect wheel 16 has a multiplicity of apertures 17 in which optical elements (not shown here) are arranged.

At its other end, the shaft 14 has a gearwheel 18 which meshes with a toothed ring 19 which surrounds the outer ring 6 of the first rolling bearing 4. The gearwheel 20 of a first drive (not shown in full here) meshes with this toothed ring 19 on the other side of the first rolling bearing 4. The outer ring 9 of the second rolling bearing 7 is also surrounded by a toothed ring 21. A gearwheel 22 of a second drive (likewise not shown in full here) meshes with this toothed ring 21.

If only the first drive is actuated, the outer ring 6 of the rolling bearing 4 is rotated about the optical axis 2, the inner ring 5 of the first rolling bearing 4 remaining in position. As a result, a desired optical element can be rotated into the region of the optical axis 2. However, it is also possible for the effect wheel 16 to be rotated continuously, in order to achieve particular light effects by means of the sequence of different "images" generated by the optical elements. For example, adjacent optical elements may be designed as patterned diaphragms, the patterns varying slightly, so that a moving image can be produced as different, successive patterned diaphragms pass through.

If only the second drive is used, the effect wheel 16 is rotated about the optical axis 2 of the effect wheel rotation system. On account of the relative movement between inner ring 5 and outer ring 6 of the first rolling bearing 4, the effect wheel 16 is at the same time rotated in the opposite direction about its centre axis 15. This leads to the optical elements, in accordance with the angular velocity of the effect wheel 16 about its centre axis 15, being moved over the region of the optical axis 2. If it is desired to compensate for this rotary movement of the effect wheel 16 in such a manner that an optical element remains in the region of the optical axis 2, the outer ring 6 of the first rolling bearing 4 has to rotate at the same angular velocity as the inner ring 5, so that there is no movement of these components relative to one another.

If the first drive is used to produce a moving image, the direction of movement of the image can be changed by the additional use of the second drive. For example, if an image of passing clouds is produced, the direction in which the clouds pass can in this way be changed from the horizontal to the vertical or in any other direction.

To simplify control of the drives, it is in this case advantageous if the transmission ratio from the gearwheel 20 of the first drive to the toothed ring 19 on the outer ring 6 of the first rolling bearing 4 is equal to the transmission ratio from the gearwheel 22 of the second drive to the toothed ring 21 on the outer ring 9 of the second rolling bearing 7.

| | |
|---|---|
| 1 | Base |
| 2 | Axis |
| 3 | Aperture |
| 4 | Rolling bearing |
| 5 | Inner ring |
| 6 | Outer ring |
| 7 | Rolling bearing |
| 8 | Inner ring |
| 9 | Outer ring |
| 10 | Connecting ring |
| 11 | Annular disc |
| 12 | Connecting ring |
| 13 | Connecting element |
| 14 | Shaft |
| 15 | Centre axis |
| 16 | Effect wheel |
| 17 | Aperture for optical element |
| 18 | Gearwheel |
| 19 | Toothed ring |
| 20 | Gearwheel |
| 21 | Toothed ring |
| 22 | Gearwheel |

What is claimed is:

1. Effect wheel rotation system for influencing a light beam which runs along an optical axis, having a base (1), at least one effect wheel (16) which is coupled to the base and has at least one eccentrically arranged optical element, a first bearing, which bears the effect wheel, for mounting the effect wheel (16) so that it can rotate about its own axis of rotation, the first bearing being at a distance from the optical axis, so that the optical element of the effect wheel (16) can be rotated into the light beam, and a drive for rotating the effect wheel (16), characterized by a second bearing, which bears the first bearing and by means of which the first bearing can be rotated about the optical axis.

2. Effect wheel rotation system according to claim 1, characterized in that the dedicated axis of rotation of the effect wheel (16) is its centre axis (15).

3. Effect wheel rotation system according to claim 1, characterized by a rolling bearing arrangement with at least two bearing shells which can rotate relative to one another and about the optical axis (2), a shaft (14) which bears the effect wheel (16) being connected to one bearing shell by means of a connecting element (13) and it being possible for the shaft (14) to roll along the other bearing shell.

4. Effect wheel rotation system according to claim 3, characterized in that the rolling bearing arrangement has a first rolling bearing with at least a first bearing shell and a second bearing shell and also a second rolling bearing (7) with at least a third bearing shell and a fourth bearing shell, both rolling bearings being arranged around the optical axis, the shaft (14) being connected to the first bearing shell by means of the connecting element (13) and it being possible for the shaft to roll along the second bearing shell, the first bearing shell being fixedly connected to the fourth bearing shell and the third bearing shell being attached to the base.

5. Effect wheel rotation system according to claim 3, characterized in that the first and second bearing shells of the first rolling bearing (4) are an inner ring (5) and an outer ring (6), in that the inner ring (5) of the first rolling bearing (4) is rotatably connected to the base (1), in that the connecting element (13) is arranged on the inner ring (5), and in that the shaft (14) can roll over the outer ring (6) of the first rolling bearing (4).

6. Effect wheel rotation system according to claim 5, characterized in that the third and fourth bearing shells of the second rolling bearing (7) are an inner ring (8) and an outer ring (9), the inner ring (8) being fixedly connected to the base (1) and the outer ring (9) being fixedly connected to the inner ring (5) of the first rolling bearing (4).

7. Effect wheel rotation system according to claim 3, characterized in that the two bearing shells which can rotate relative to one another and about the optical axis can be rotated by means of in each case one drive.

8. Effect wheel rotation system according to claim 7, characterized in that the drives of the bearing shells have the same transmission ratio.

9. Effect wheel rotation system according to claim 7, characterized in that the bearing shells, and also the shaft (14), are driven via a geared transmission.

10. Effect wheel rotation system according to claim 7, characterized in that the connecting element (13) is designed in the form of an annular disc around the optical axis and is provided with a toothed ring in which a drive engages.

11. Effect wheel rotation system according to claim 7, characterized in that the connecting element has a lever arm, the lever arm having an articulated joint between the bearing shell which bears the lever arm and the shaft (14) or being articulatedly mounted on this bearing shell and being pivotable about the articulated joint by means of a drive.

12. Effect wheel rotation system according to claim 7, characterized in that the connecting element is designed with a telescopic lever arm and its length can be changed by means of a drive.

* * * * *